US007246737B2

(12) United States Patent
Teixidor Casanovas

(10) Patent No.: US 7,246,737 B2
(45) Date of Patent: Jul. 24, 2007

(54) STACKABLE BOX FOR PERISHABLE PRODUCTS

(75) Inventor: Pedro Teixidor Casanovas, Villava (ES)

(73) Assignee: Videcart, S.A., Villava (ES)

( * ) Notice: Subject to any disclaimer, the term of this patent is extended or adjusted under 35 U.S.C. 154(b) by 1 day.

(21) Appl. No.: 10/508,835

(22) PCT Filed: Nov. 14, 2002

(86) PCT No.: PCT/ES02/00530

§ 371 (c)(1),
(2), (4) Date: Jun. 15, 2005

(87) PCT Pub. No.: WO2004/043796

PCT Pub. Date: May 27, 2004

(65) Prior Publication Data

US 2005/0242164 A1 Nov. 3, 2005

(51) Int. Cl.
*B65D 21/032* (2006.01)
*B65D 5/32* (2006.01)

(52) U.S. Cl. ..... 229/191; 229/918

(58) Field of Classification Search ..... 229/191, 229/915, 918, 919
See application file for complete search history.

(56) References Cited

U.S. PATENT DOCUMENTS 2,885,140 A * 5/1959 Guyer ..... 229/918
3,268,147 A * 8/1966 Burger ..... 229/191
5,992,735 A * 11/1999 Oosterbaan ..... 229/191
6,270,009 B1 * 8/2001 Heeren ..... 229/918
6,378,764 B1 * 4/2002 Teixidor Casanovas ..... 229/191
6,651,875 B2 * 11/2003 Chu ..... 229/191
6,868,968 B1 * 3/2005 Casanovas ..... 206/509
6,886,738 B2 * 5/2005 Teixidor Casanovas ..... 229/191

FOREIGN PATENT DOCUMENTS

| | | | |
|---|---|---|---|
| EP | 575004 | A1 | 12/1993 |
| GB | 2196608 | A | 5/1988 |
| WO | 98/25830 | | 6/1998 |
| WO | 00 20286 | A1 | 4/2000 |
| WO | 00 68103 | A1 | 11/2000 |
| WO | WO-00/68097 | A1 * | 11/2000 |

* cited by examiner

*Primary Examiner*—Gary E. Elkins
(74) *Attorney, Agent, or Firm*—Lowe Hauptman & Berner

(57) ABSTRACT

The box, which can be made from a single sheet or from five separate pieces which are fastened to one another to form the box, is such that at the front ends, extensions project with transverse folding lines to form corner reinforcements. The extensions that form these reinforcements present four folding lines that define the sectors, which form an initial sector which is attached to the inner face of the side, a second sector with a diagonal disposition, a third sector which is attached on the inside of the front, a fourth sector which lies at right angles to the diagonal sector, and a last sector which is attached to one of the two halves of the inner face of the diagonal sector. At their upper edge the sectors present flanges which form projections perpendicular to one another, for positioning in matched opposing notches when the boxes are stacked.

2 Claims, 5 Drawing Sheets

1
2
2
3
4
5
6
7
8
9
10
11
12
13
13
14
15
16
17
18
19
20

STACKABLE BOX FOR PERISHABLE PRODUCTS

CROSS REFERENCE TO RELATED APPLICATIONS

The present application is based on, and claims priority from, International Application Number PCT/ES2002/00530, filed Nov. 14, 2002, the disclosure of which is hereby incorporated by reference herein in its entirety.

BACKGROUND OF THE INVENTION

1. Field of the Invention

The present invention relates to a stackable box for perishable products, made from a sheet of compact cardboard with stamped, cutting and folding lines for assembly purposes, although it may also be made up of five separate pieces of the same material, likewise with cutting, stamped and folding lines, for being glued together so as to be able to make up the box.

More specifically, the invention is directed to provide a box for perishable goods of the above-mentioned type, provided with triangular prismatic reinforcements in the corners with upper protruding flanges in the corners, all configured in such a way in its conformation the box offers high compression strength at these upper flanges, as a result of which, besides obtaining reinforcement at every corner, reinforcement of these protruding flanges is also obtained.

2. Description of the Related Art

PCT/ES 9825830 describes a stackable box for transporting perishable products and the like, which is made up of five separate parts forming the bottom, the sides and the fronts, these having transverse folds at their ends to conform triangular prismatic reinforcements at the actual corners when assembling. In this box stacking stability is achieved by means of double and triple flanges provided at the upper edge of the walls corresponding to those prismatic corner reinforcements, flanges that are housed in respective windows provided for the purpose at the bottom.

Spanish utility model U200101538, discloses to a stackable tray for perishable products, which, in this case, is obtained from the development of a single sheet whose fronts are provided at their end sections with transverse folding lines for forming triangular prismatic reinforcements at the actual corners, while also having protruding upper flanges that are accommodated in windows made for the purpose in the bottom so as to achieve stability and the proper positioning of the stacked boxes.

Both in one case and the other, i.e. whether the box is made from five separate pieces, as happens in PCT/ES 98/25830, or as in utility model U200101538, where the box is made from a single piece, the flanges provided at the top of the corners to achieve the stability and correct positioning between boxes when stacking always match up with the upper edges close to the sharp corners of the box, which gives rise to constant rubbing, bending, etc, of these flanges, resulting in a loss of strength, damage and, therefore, and their possible unserviceability, so that they do not effectively perform the function for which they are intended.

SUMMARY OF THE INVENTION

The box being advocated, which may either be made out of a single sheet stamped, cutting or folding lines or from five separate pieces, also with pre-perforation, folding or cutting lines, offers a series of improvements in the extensions that will be formed by the prismatic corner reinforcements with a view, not only to achieving considerable strength in box stacking, but also substantial reinforcement in the actual upper flanges, as these are related in such a way that in the making or assembly of the box they are located away from the edges and corners of the box, and in addition they form flanges that are disposed at right angles to one another, which endows them with great stacking compression strength, besides tighter fitting between stacked boxes and a reduction in the number of flanges to be engaged for anchoring purposes during stacking.

More specifically, the box of the invention is characterised in that the extensions projecting from the fronts to form the prismatic corner reinforcements present, after an initial folding line, four transverse folding lines defining five sectors, which are folded one after another, one of them abutting onto the inside face of the respective side, while the second sector is arranged diagonally in the respective corner and the third sector is up against the inner face of the front end. The fourth sector is arranged diagonally in that corner, i.e. between the inner edge or dihedral angle formed by the first sector and the front end and the diagonally disposed sector, whilst the last sector is up against an inner face of the diagonally disposed sector, both folded to one side and to the opposite side, forming two triangular compartments in the triangular configuration defined by the first three sectors.

In addition, the diagonally disposed sector presents a flange at its top edge, while the last two sectors present a common flange with one part on one side of the folding line defining these two sectors and the other part on the other side, so that during assembly by folding two flanges are determined which will be disposed at right angles to each other, one of which will be at right angles to the flange of the diagonally disposed sector, while the other is up against the half of that diagonally disposed sector flange.

In this way, a reinforcement is formed at the flanges due to their arrangement, besides being located in an offset position in relation to the side edges or corners.

Perpendicularly opposing the above-mentioned flanges, the corresponding sectors have respective notches which will form the locating cavity for the upper flanges when the boxes are stacked.

In addition, the fronts have an upper bridge provided with a window which are precisely facing the configuration of the flanges corresponding to the corner reinforcements, so that they are located in these front end bridge windows and a perfect anchorage is obtained when the box are stacked on top of one another, resulting in optimum stabilization and compression strength.

Finally, it should be mentioned that the aforesaid flanges have a semi-hexagonal configuration as opposed to the semi-octagonal configuration of the flanges provided on conventional boxes.

BRIEF DESCRIPTION OF THE DRAWINGS

To supplement the description being given and in order to assist a clearer understanding of the features of the invention, in accordance with a preferred example of a practical embodiment of same, a set of drawings is attached as an integral part of said description wherein for purely illustrative and never restrictive purposes there is represented the following.

DESCRIPTION OF THE EXEMPLARY EMBODIMENTS OF THE INVENTION

Figures 1A, 1B:
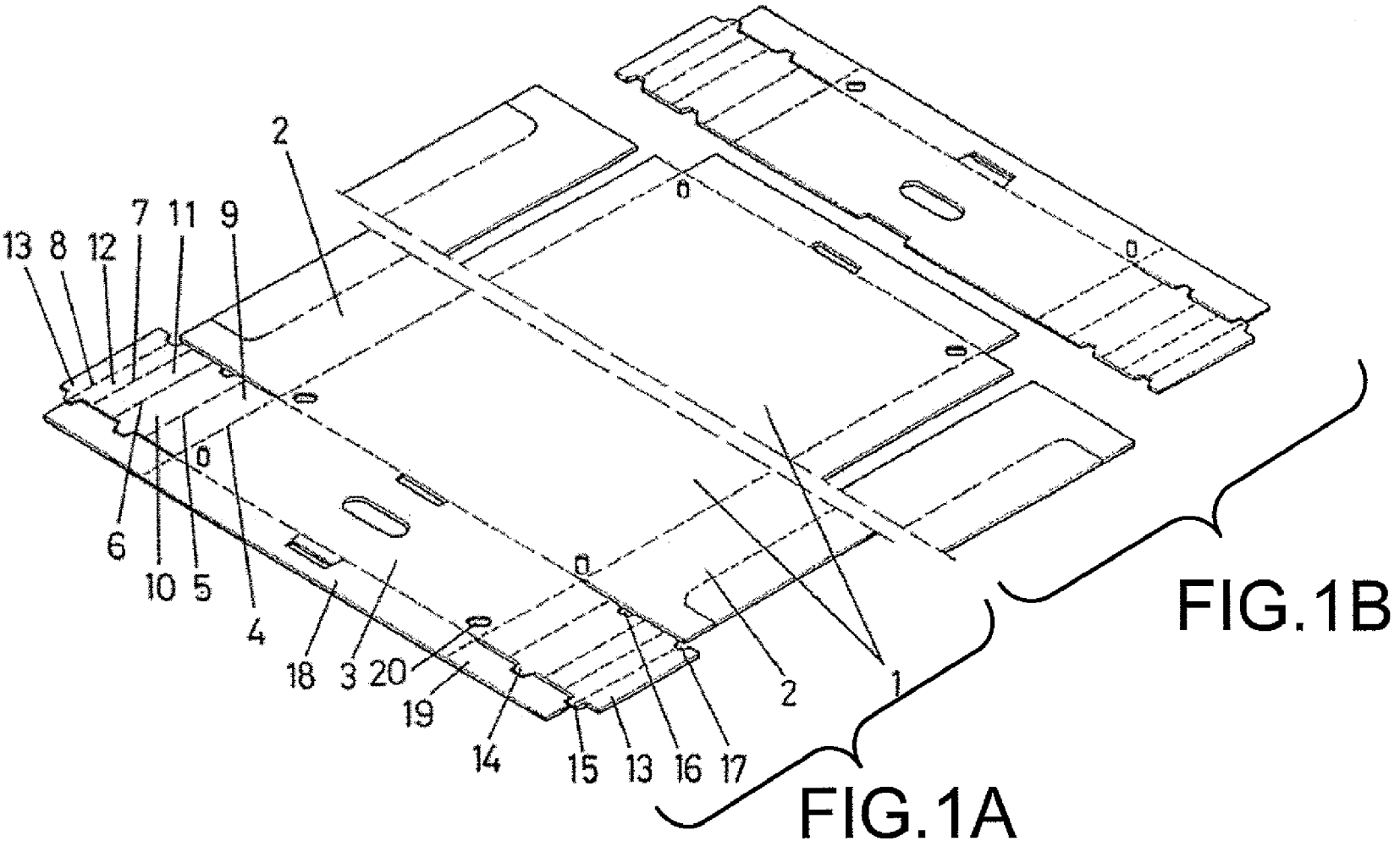
FIGS. 1A and 1B show the development corresponding to the parts of a box made in accordance with the improvements of the invention, with FIG. 1A depicting the box as a one-piece body, and FIG. 1B depicting the box composed of five separate pieces, the object of the invention being applicable both to one type of box and the other, as the improvements have absolutely no effects on whether the box is composed of a single piece or is made up of five pieces.

In the light of the above-mentioned figures it may be observed that the box of the invention, whether produced from a single piece as represented in one of the halves of FIG. 1 or produced by means of five separate pieces, as is observed in the other half of the same FIG. 1, comprises a bottom (1), two larger sides (2) and the corresponding ends (3).

Figure 2:
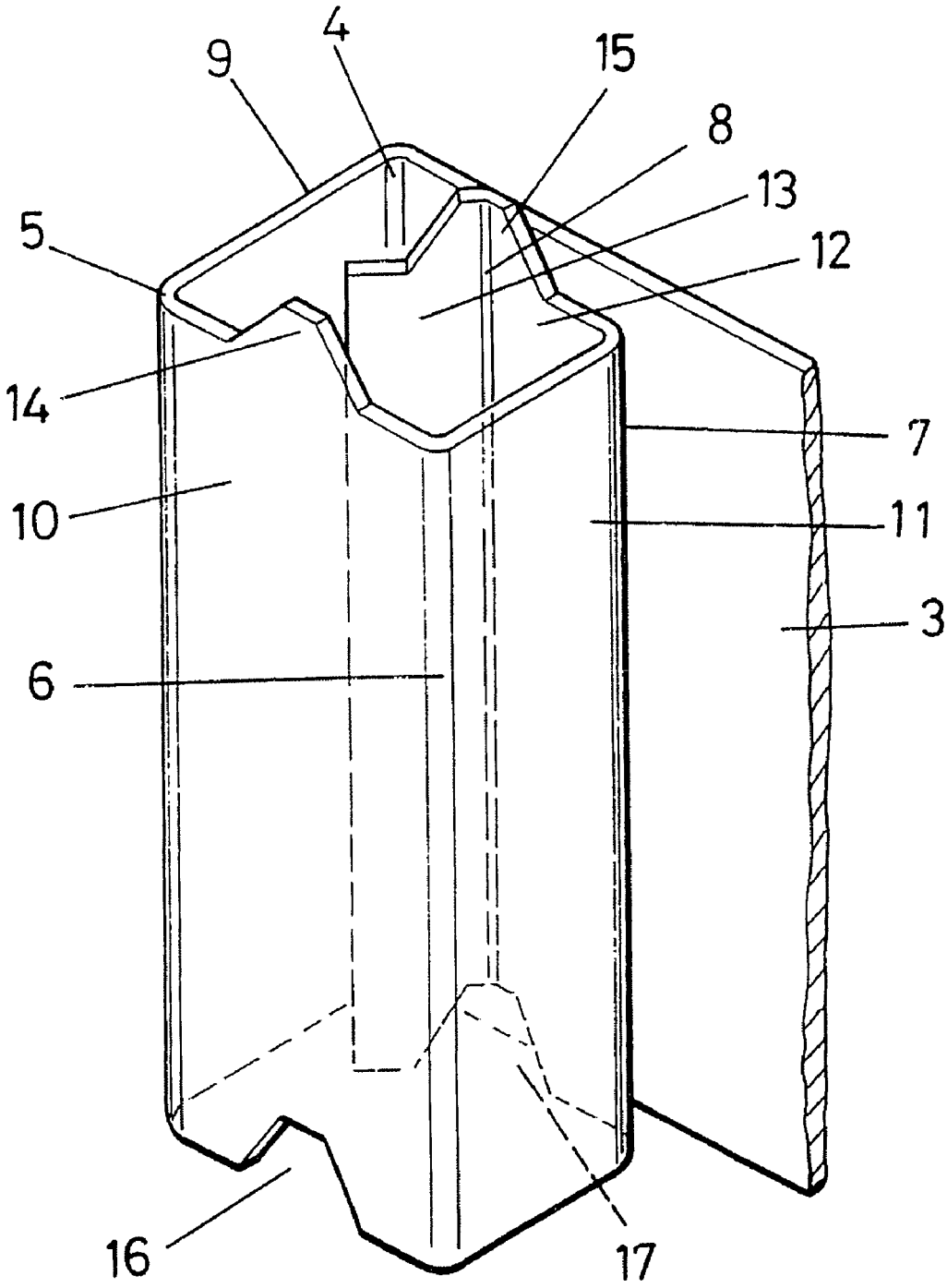
FIG. 2 is a perspective view, according to an intermediate folding stage, of the extension that is going to form the reinforcement corresponding to one of the corners of the box that is the object of the invention.
Figure 3:
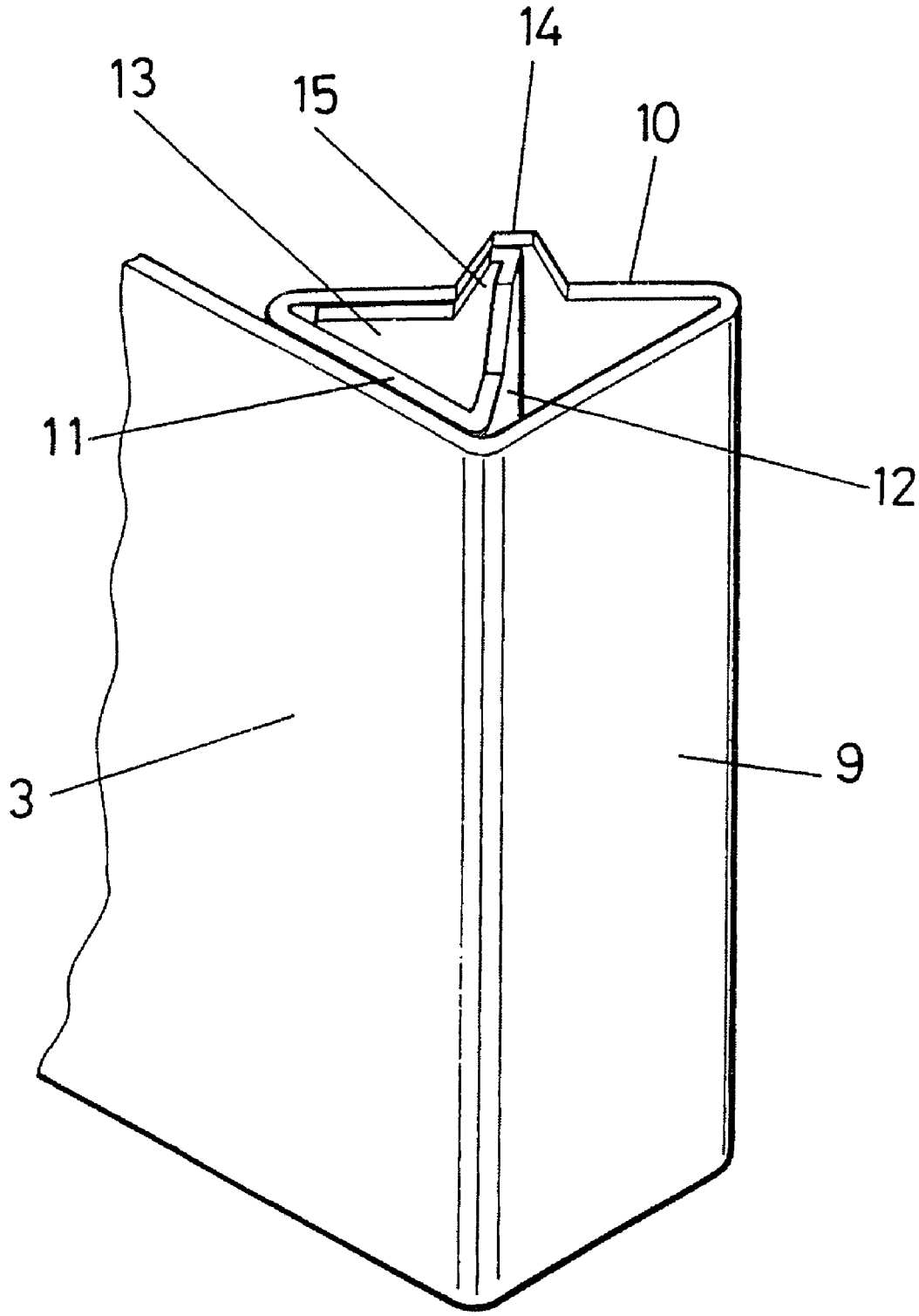
FIG. 3 is an upper perspective view of the corner reinforcement obtained from FIG. 2.
Figure 4:
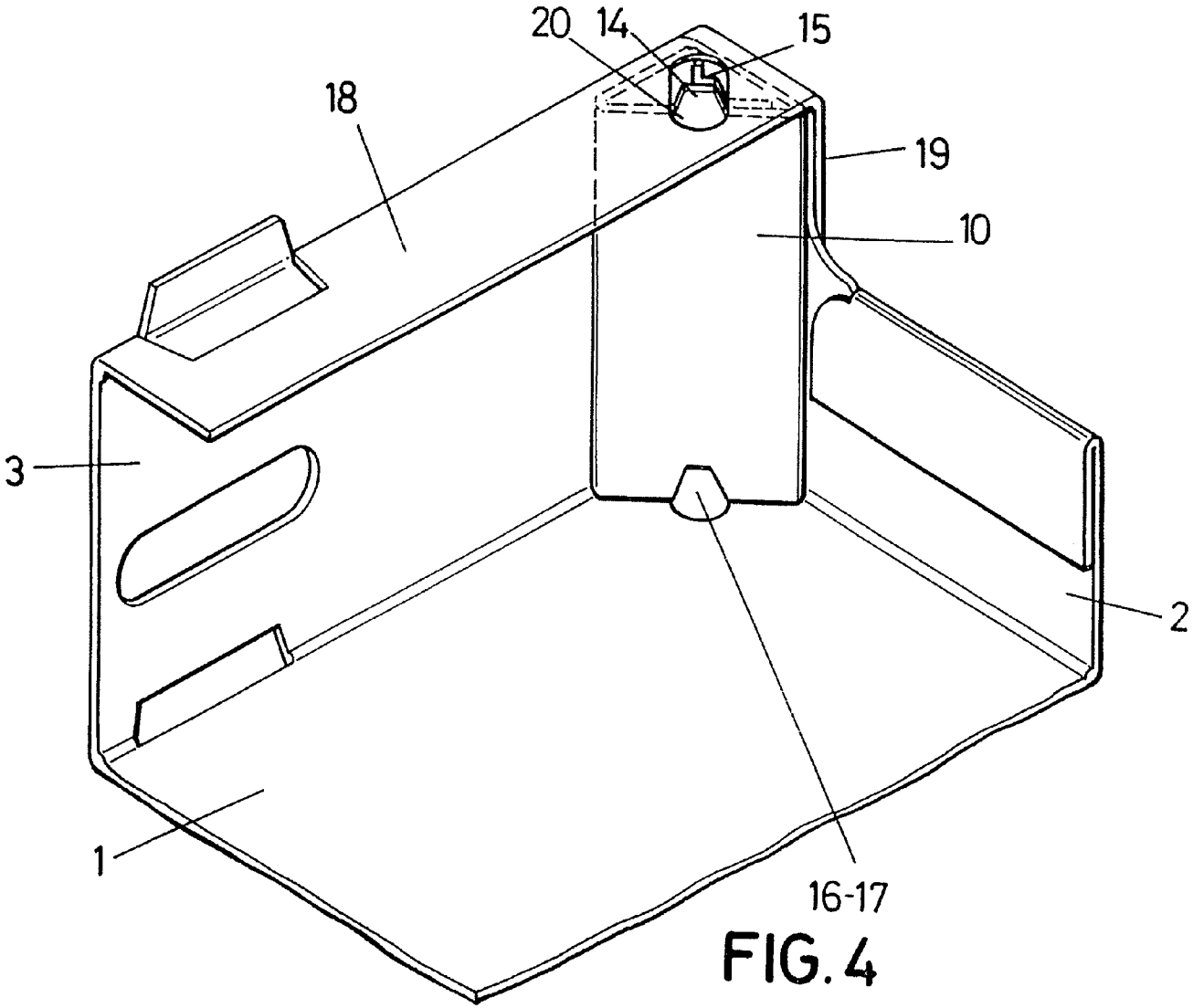
FIG. 4 is an upper perspective view of a portion corresponding to a box corner, i.e. comprising part of the bottom, part of the end and part of the side of that corner, as well as the actual reinforcement, at the fully assembled stage.
Figure 5:
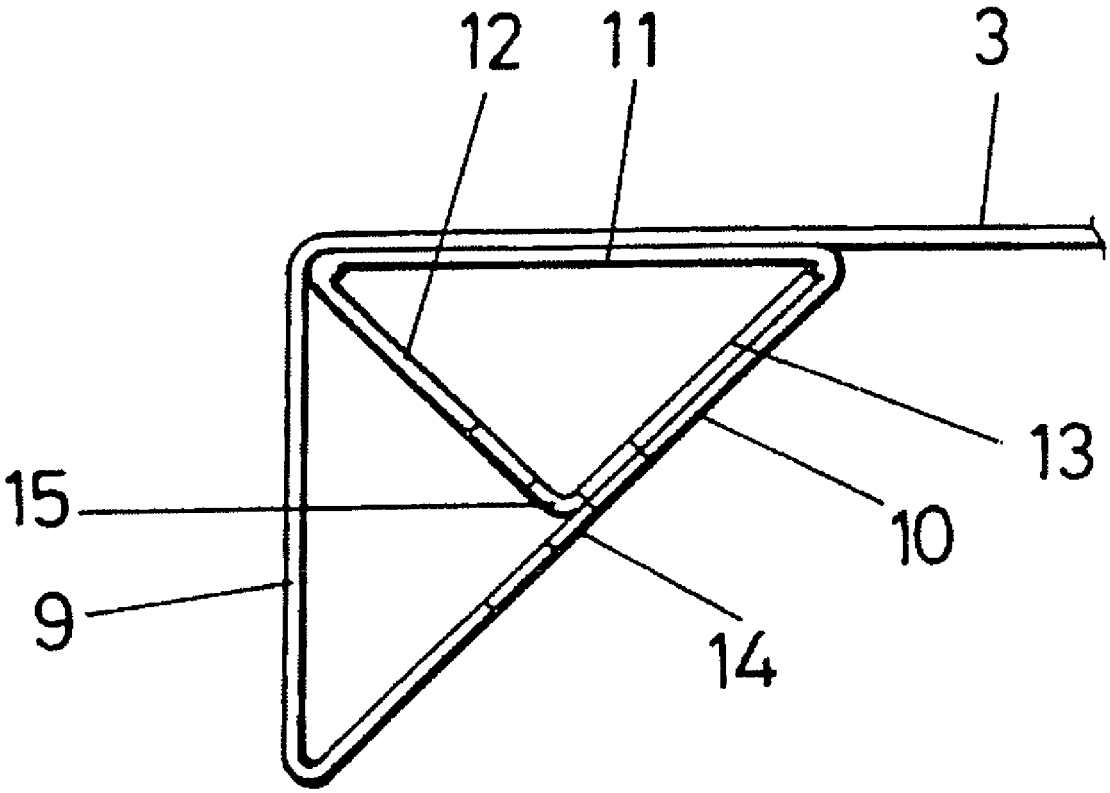
FIG. 5 is an upper plan view of the corner reinforcement produced in accordance with the object of the invention.

Irrespective of the constitution both of the sides (2) and of the ends (3), these present respective end extensions which will determine the corner reinforcements, extensions which, as represented in FIGS. 1 and 2, are determined on the basis of a transverse folding line (4), the former having the folding lines (5), (6), (7) and (8), all of them transverse, defining respective sectors (9), (10), (11), (12) and (13) which, after suitable folding by means of the aforesaid folding lines, will form the prismatic corner reinforcement, as shown in FIGS. 3, 4 and 5.

The sectors (10) and (12–13) have respective flanges (14) and (15), matching up with the upper edge, inasmuch as these same sectors (10) and (12–13), at the lower edge and opposingly to the flanges (14) and (15) present respective complementary recesses or notches (16) y (17).

Furthermore, the fronts (3) have an upper bridge (18) extended at each end with overlaps (19) which are attached to the sides (2) of the box when it is assembled.

In the assembly or forming of the box, the first sector (9) of the extensions that are going to make up the reinforcements is attached to the inner face of the respective side (2), while the following sector (10) remains in the diagonal disposition in the corner, while the sector (11) is attached to the inner face of the front (3). For its part, the sector (12) remains in the diagonal disposition in relation to the dihedron formed by the front (3) and the first sector (9), i.e. the corners, that sector (12) being perpendicular to the diagonally disposed sector (10), while sector (13) is attached and superimposed on the inner face of one of the halves of the sector (10), to one side or the other of same.

In this layout, as is represented in FIGS. 4 and 5, the flange (14) of the sector (10) lies perpendicular to one of the halves of the flange (15) of the sector (12), while the other half of this flange (15), which belongs to the end sector (13), is attached to the half of the flange (14) of the sector (10), as is represented clearly in FIG. 3, although provision should also be made for the aforesaid sector (13) to be able to be attached to the opposite side of the inner face of the sector (12), whereby the sectors that will constitute the upper projections of the corners form a right angle to one another, which is positioned and located in a slotted window (20) provided in each of the end parts of the bridges (18) of the fronts (3), as is represented in FIG. 4, it being foreseen that the notches (16) and (17) form a cavity or recess in the bottom of each one of the reinforced corners for the location precisely of the projecting parts of those flanges (14–15), when the boxes are stacked on one another. Obviously, the sectors that are superimposed, whether those that form the reinforcements and those corresponding to the extensions (14) and (15) are glued to one another, forming in any case a sturdy reinforcement in each of the corners and projections or flanges that are likewise compression resistant when stacking.

The invention claimed is:

1. Stackable box for perishable goods, comprising:

a bottom, two longer sides, and two front sides configured to define four corners, each of the front sides having two end extensions with transverse folding lines so that the end extensions once folded and assembled form four prismatic reinforcements, one in each of the four corners, wherein the end extensions have four transverse folding lines each, which define, together with and starting from an initial folding line which separates the front side from its corresponding end extension, first, second, third, fourth and fifth sectors, the first sector being defined between the initial folding line and an innermost of the four transverse folding lines in the end extension, the second sector being defined between the innermost and the consecutive outer of the four transverse folding lines, such that once the stackable box is assembled:

each first sector is adjacent to an inner face of a longer side;

each second sector is arranged in a diagonal disposition with respect to a corner;

each third sector is adjacent to an inner face of a front side;

each fourth sector is arranged in a diagonal disposition opposite a dihedron formed by a first sector and a correlative front side, and is oriented at right angles to a second sector; and each fifth sector is attached to an inner face a half of the diagonal sector; and wherein the second sector, and the fourth and fifth sectors respectively have first and second flanges, respectively, at their upper edge, the second flange extending from half of the fourth sector to half of the fifth sector; this second flange, in the assembled box, comprising two semi-flanges, one semi-flange perpendicular to the first flange and the other semi-flange adjacent to a half of the first flange, the first and second flanges thereby forming a reinforcement;

and wherein the second sector, and the fourth and fifth sectors respectively have first and second notches, respectively, at their bottom edges, defined in an opposing and complementary way with respect to the corresponding first and second flanges, and adapted such that when stacking two or more stackable boxes, the first and second flanges are positioned in recesses corresponding to the first and second notches.

2. Stackable box for perishable goods, as defined in claim 1, wherein the front sides are provided with a horizontal upper bridge each, which horizontal upper bridge is provided in its outermost portions with holes for accommodating the first and second flanges.

* * * * *